US010401116B1

(12) United States Patent
Kokoruda et al.

(10) Patent No.: US 10,401,116 B1
(45) Date of Patent: Sep. 3, 2019

(54) PULL-THROUGH APPLICATOR ASSEMBLY FOR A FIREARM

(71) Applicant: Michaels of Oregon Co., Overland Park, KS (US)

(72) Inventors: Laurie A. Kokoruda, Bonner Springs, KS (US); Jason L. Slinkard, Blue Springs, MO (US); Paul Fischer, Olathe, KS (US)

(73) Assignee: MICHAELS OF OREGON CO., Overland Park, KS (US)

( * ) Notice: Subject to any disclaimer, the term of this patent is extended or adjusted under 35 U.S.C. 154(b) by 0 days.

(21) Appl. No.: 15/946,948

(22) Filed: Apr. 6, 2018

Related U.S. Application Data

(60) Provisional application No. 62/482,973, filed on Apr. 7, 2017.

(51) Int. Cl.
*B08B 9/043* (2006.01)
*F41A 29/02* (2006.01)

(52) U.S. Cl.
CPC ..... *F41A 29/02* (2013.01); *B08B 9/0436* (2013.01)

(58) Field of Classification Search
CPC ..... F41A 29/02; B08B 9/0436
See application file for complete search history.

(56) References Cited

U.S. PATENT DOCUMENTS 621,857 A 3/1899 Scott
1,164,665 A * 12/1915 Reeves ..... F41A 29/02 15/104.16
1,172,746 A 2/1916 Silverstein
2,544,847 A 3/1951 Malesky
(Continued)

FOREIGN PATENT DOCUMENTS

DE 2702977 A1 * 7/1978 ..... F41A 29/02
EP 0082230 A1 * 6/1983 ..... F41A 29/02
GB 487754 A * 6/1938 ..... F41A 29/02

OTHER PUBLICATIONS

Irene A. Blake , "How to Clean a Boresnake", https://goneoutdoors.com/clean-boresnake-6702566.html, (Year: 2017).*
(Continued)

*Primary Examiner* — Stephen Johnson
*Assistant Examiner* — Joshua T Semick
(74) *Attorney, Agent, or Firm* — Seyfarth Shaw LLP; Brian Michaelis; Joseph M. Walker

(57) ABSTRACT

A pull-through applicator assembly for maintenance of a gun barrel. The pull-through applicator assembly is a unitary, disposable, and configured for easy manufacturing relative to conventional pull-through assemblies. The economics of the disclosed pull-through applicator assembly is sufficient to permit packaging and sale as a disposable unit, for discarding after a single use. The single-use aspect enables the fibrous body to be configured primarily for compliance to the internal geometry of the gun barrel (e.g., the grooves of the rifling) without need for considering the durability over multiple uses. Accordingly, enhanced contact with the internal geometry of the gun barrel is realized in the convenient form of a pull-through applicator that is disposable. The pull-through applicator may be configured of biodegradable materials to enhance the disposable aspect.

22 Claims, 3 Drawing Sheets

(56) References Cited

U.S. PATENT DOCUMENTS

| | | | | |
|---|---|---|---|---|
| 2,642,602 | A | 6/1953 | Kelly | |
| 2,897,525 | A | 8/1959 | Goodwin et al. | |
| 3,205,518 | A | 9/1965 | Romaine | |
| 3,438,461 | A * | 4/1969 | MacPherson | B05C 7/08 118/254 |
| 3,708,820 | A | 1/1973 | Schultea | |
| 4,010,565 | A | 3/1977 | DiProspero | |
| 4,399,627 | A | 8/1983 | Malesky et al. | |
| 5,074,074 | A | 12/1991 | Yeadon | |
| 5,171,925 | A | 12/1992 | Mekler | |
| 5,588,242 | A | 12/1996 | Hughes | |
| 5,972,125 | A * | 10/1999 | Hedge | F41A 29/02 134/8 |
| 6,088,866 | A | 7/2000 | Hedge | |
| 6,630,034 | B1 | 10/2003 | Schnell | |
| 6,889,402 | B2 | 5/2005 | Galantai | |
| 7,356,961 | B2 | 4/2008 | Williams | |
| 7,367,151 | B1 | 5/2008 | Black et al. | |
| 7,441,363 | B1 | 10/2008 | Black et al. | |
| 8,136,438 | B2 * | 3/2012 | Shakespeare | A62B 1/16 87/6 |
| 8,458,947 | B2 | 6/2013 | Iosso et al. | |
| 8,616,367 | B2 * | 12/2013 | Williams | F41A 29/02 206/223 |
| 8,707,607 | B2 * | 4/2014 | Williams | F41A 29/02 206/362 |
| 8,800,191 | B2 | 8/2014 | Williams et al. | |
| 8,943,731 | B2 | 2/2015 | Niebling | |
| 9,095,286 | B2 | 8/2015 | Vazales et al. | |
| 9,115,945 | B2 * | 8/2015 | Williams | F41A 29/02 |
| 9,228,790 | B2 * | 1/2016 | Stephens | F41A 29/02 |
| 9,339,349 | B2 | 5/2016 | Pisacane | |
| 9,441,903 | B2 * | 9/2016 | Brooker | F41A 29/02 |
| 9,528,800 | B2 * | 12/2016 | Havens | F42B 7/08 |
| 9,658,021 | B2 * | 5/2017 | Brooker | F41A 29/02 |
| 9,702,654 | B2 * | 7/2017 | Brooker | F41A 29/02 |
| 10,100,462 | B2 * | 10/2018 | Kikuchi | A01K 75/00 |
| 2004/0111948 | A1 | 6/2004 | Schnell | |
| 2004/0159331 | A1 | 8/2004 | Katsin | |
| 2010/0155270 | A1 | 6/2010 | Dewey | |
| 2011/0016649 | A1 | 1/2011 | Reggio et al. | |
| 2014/0123530 | A1 | 5/2014 | Williams et al. | |
| 2016/0223282 | A1 | 8/2016 | Brooker | |
| 2017/0146313 | A1 * | 5/2017 | Briody | F41A 29/02 |

OTHER PUBLICATIONS

"The Otis Elite®—Otis Technology", https://otistec.com/the-otis-elite/, (Year: 2017).*

Downloaded from the Internet on Mar. 6, 2017 at http://www.outersguncare.com/products/cleaningkits/pull-thru_kits.aspx. "Disposable Pull Thru Kits" 1 pg.

* cited by examiner

PULL-THROUGH APPLICATOR ASSEMBLY FOR A FIREARM

RELATED APPLICATIONS

This application claims the benefit of U.S. Provisional Application No. 62/482,973, filed Apr. 7, 2017, the disclosure of which is hereby incorporated by reference herein in its entirety.

BACKGROUND OF THE DISCLOSURE

Maintenance systems for gun barrels typically involve cleansing the barrel of a firearm with a cleaning solvent, sometimes followed by application of an oil or other rust inhibitor. A common form for cleansing the barrel and applying the rust inhibitor are so-called "pull-through" devices, which feature a compressible body at the end of a rope or string. The body is oversized relative to the bore of the gun barrel to be cleaned, so that the body exerts a radial force against the interior surface of the bore when inserted into the barrel. The body is then pulled through the length of the barrel using the rope or string, with the interference between the body and the bore providing a snug-fitting sweep of the bore, leaving behind a coating of the solvent or rust inhibitor.

Challenges arise for rifled barrels. The spiraled grooves typically harbor debris that are more difficult to reach than, for example, smooth bore barrels. A device that provides enhanced contact with the grooves of rifled barrels in an economical form would be welcomed.

SUMMARY OF THE DISCLOSURE

Various embodiments of the disclosure provide a unitary, disposable pull-through applicator assembly, configured for easy manufacturing with a reduced number of manufacturing steps relative to conventional pull-through assemblies. The economics of the disclosed pull-through applicator assembly permits packaging and sale as a disposable unit, for discarding after a single use. The single-use aspect enables the device to be configured primarily for compliance to the internal geometry of the gun barrel (e.g., the grooves of the rifling) without need for considering the durability over multiple uses. Accordingly, enhanced contact with the internal geometry of the gun barrel is realized in the convenient form of a pull-through applicator.

Various embodiments of the disclosure include a pull-through applicator assembly configured for enhanced contact with the bore and rifling of a gun barrel. The pull-through applicator assembly includes an expanded portion that surrounds a fibrous applicator body wrapped within an expanded sleeve. In some embodiments, a majority of the surface of the expanded portion is open to expose the fibrous applicator body for contacting the bore of a firearm during a cleaning or oiling operation. For firearms having rifled barrels, the shape of the fibrous body is readily reformed, enabling the strands of the open mesh and, in some embodiments, the fibrous body itself to reach deeper into the rifled grooves than conventional pull-through devices. The fibrous applicator body can also be fabricated from an absorbent material (e.g., cotton), which assists in retention of the liquid being dispensed by the applicator.

Pull-through systems have found favor for the cleaning and maintenance of bores and rifling of gun barrels. An advantage of pull-through devices is that the barrel is cleaned by pulling the device through the barrel in one direction only. Debris and residue that is present on the interior surfaces of the gun barrel are thus swept in one direction, which provides an advantage over traditional rod-type bore cleaner, where the cleaning article must be retracted back through gun barrel after the initial cleaning stroke. The act of retracting a rod-type bore cleaner requires that the cleaning wad or brush, which is fouled from the initial stroke through the barrel, be drawn back through the barrel, which can leave contaminants in the barrel during to the retracting stroke.

Conventional pull-through barrel cleaning systems also include various shortcomings. Some systems include a thick sleeve that contacts the bore of the gun barrel. The thickness of the sleeve sometimes limits the ability of the surface to conform to the internal radial geometry of the barrel (e.g., spiral grooves formed in the barrel for rifling). Other pull-through devices include paper-based patches that are attached to the pull-through device. The durability of the patches preclude repeated uses of more than a few uses, and the complexity of these pull-through devices makes them prohibitively expensive for single use applications.

Various embodiments of the pull-through applicator system of the present disclosure addresses these shortcomings. We have found that a fibrous applicator body wrapped in an open mesh formed from the strands of a braided cord to expose the fibrous applicator body provides superior applicator performance over the thick sleeve or the paper-based applicators of conventional pull-through devices. In some embodiments, the braided cord comprises strands that expand laterally to form flat ribbons when wrapped around the applicator body, such that the applicator is effectively wrapped in a sheath of flat ribbons that are thin relative to the thick strands of conventional pull-through devices. The thinner sleeve is more compliant than the thick sleeves or the paper-based applicators of conventional pull-through devices. In some embodiments, the retention capabilities of an absorbent applicator provides superior delivery of fluid over the length of the barrel during maintenance procedures. Manufacturing costs are sufficiently low to permit the disclosed pull-through applicator system to be marketed as a disposable device. Some embodiments utilize biodegradable materials to enhance the disposable aspect of the device.

Structurally, various embodiments of the disclosed pull-through applicator assembly for maintenance of a gun barrel comprises a braided cord including a plurality of strands that are interwoven, a guide weight affixed proximate a first end of the braided cord, an applicator body affixed proximate a second end of the braided cord, a coupling disposed at the second end of the braided cord. The braided cord includes an expanded portion that forms an open mesh that surrounds the applicator body, the open mesh being separated over the expanded portion to expose a majority of an outer surface of the applicator body. The coupling secures the plurality of strands together at the second end of the braided cord to capture the applicator body within the open mesh.

In some embodiments, the guide weight encases the plurality of strands proximate the first end of the braided cord. The applicator body may be substantially cylindrical, and may include a fibrous material. In some embodiments, the fibrous material is cotton. In some embodiments, the braided cord, fibrous applicator body, and coupling are biodegradable. In some embodiments, the guide weight is also biodegradable. In some embodiments, the applicator body includes an outer diameter that is sized for an interference fit with a bore of a gun barrel, and may also be configured to contact a diameter of a rifling defined within the gun barrel. The braided cord may include nylon or rayon. In some embodiments, the guide weight includes a polymer.

In various embodiments of the disclosure, a method for maintenance of a barrel of a firearm is disclosed, comprising providing a kit for maintenance of a barrel of a firearm, the kit including the above-disclosed pull-through applicator assembly, a packet containing a liquid to be applied to the barrel of the firearm, and instructions on a non-transitory, tangible medium. The instructions include passing the guide weight through a barrel of a firearm to exit a muzzle end of the barrel, coating at least a portion of the applicator body of the pull-through applicator assembly with the liquid from the packet, pulling the applicator body through the barrel of the firearm to exit the muzzle end of the barrel, and discarding the pull-through applicator assembly.

In various embodiments of the disclosure, a method of manufacturing a pull-through applicator assembly for maintenance of a gun barrel is disclosed, comprising: interweaving a plurality of strands to form a braided cord proximate a first end of the pull-through applicator assembly; interweaving the plurality of strands about an applicator body proximate a second end of the pull-through applicator assembly to form an open mesh about the applicator body; affixing a guide weight to the first end of the pull-through applicator assembly; and securing the plurality of strands in a bundle at the distal end of pull-through applicator assembly to capture the applicator body within the open mesh. The step of securing the plurality of strands in the bundle may include bonding the distal ends of the plurality of strands together. The step of affixing the polymer guide weight to the first end of the pull-through applicator assembly may include gluing the polymer guide weight to the first end of the pull-through applicator assembly.

In various embodiments of the disclosure, a pull-through applicator assembly for maintenance of a gun barrel comprises a braided cord including a plurality of strands that are interwoven, a guide weight affixed proximate a first end of the braided cord, a fibrous applicator body affixed proximate a second end of the braided cord, and a coupling disposed at the second end of the braided cord. In some embodiments, each of the plurality of strands of the braided cord are of a substantially circular cross-section proximal to the fibrous applicator body, and the plurality of strands form a woven mesh that covers a majority of the fibrous applicator body. In some embodiments, the strands of the woven mesh are flattened into ribbon form over the fibrous applicator body. The guide weight may encase the plurality of strands proximate the first end of the braided cord. In some embodiments, the coupling secures the plurality of strands together at the second end of the braided cord to capture the fibrous applicator body within the open mesh. In some embodiments, the braided cord, the fibrous applicator body, and the coupler are biodegradable. The woven mesh may cover at least 70% of an outer surface of the applicator body. In some embodiments, a ratio of a width of the ribbon form of a one of the plurality of strands to a diameter of the substantially circular cross-section of the one of the plurality of strands is in a range of 5 to 20 inclusive.

DETAILED DESCRIPTION OF THE FIGURES

Figure 1:
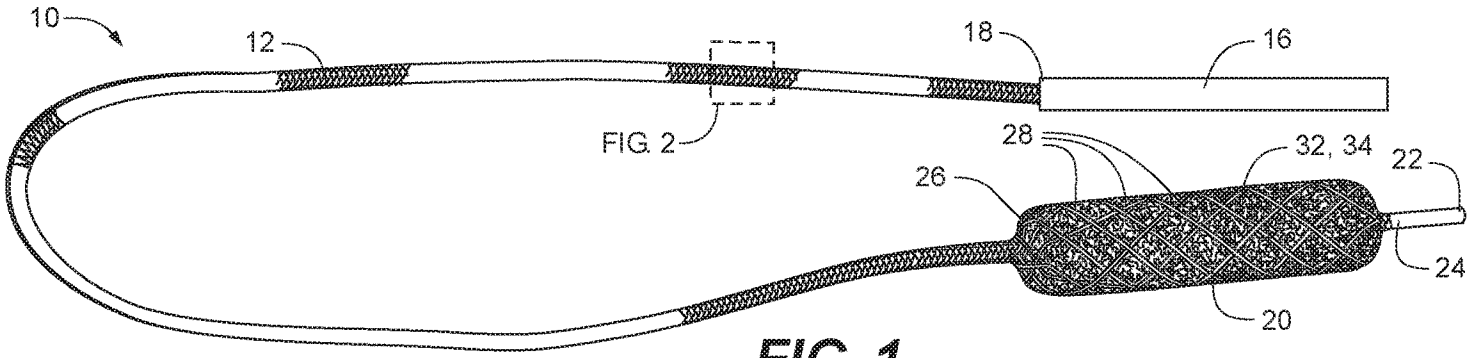
FIG. 1 is a plan view of a pull-through applicator assembly having an open mesh surrounding an applicator body according to an embodiment of the disclosure.
Figure 2:
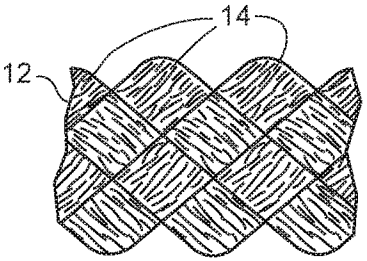
FIG. 2 is an enlarged partial view of the pull-through applicator assembly of FIG. 1 according to an embodiment of the disclosure.

Referring to FIGS. 1 and 2, a pull-through applicator assembly 10 for maintenance of a gun barrel is depicted according to an embodiment of the disclosure. The pull-through applicator assembly 10 comprises a braided cord 12 including a plurality of strands 14 that are interwoven. A guide weight 16 is affixed proximate a first end 18 of the braided cord 12. An applicator body 20 is affixed proximate a second end 22 of the braided cord 12. In some embodiments, the guide weight 16 encases the plurality of strands 14 proximate the first end 18 of the braided cord 12. A coupling 24 may be defined at the second end 22 of the braided cord 12, where the plurality of strands 14 are joined together.

The braided cord 12 includes an expanded portion 26 that surrounds the applicator body 20. In some embodiments, to surround the applicator body 20, the plurality of strands 14 are separated to effectively form an open mesh 28 (akin to a netting) about the applicator body 20. The open mesh 28 defines open spaces 32 that are sufficiently large so that a majority of an outer surface 34 of the applicator body 20 is exposed. In some embodiments, up to 70% of the outer surface 34 is exposed through the open spaces 32 of the open mesh 28. In some embodiments, up to 80% of the outer surface 34 is exposed through the open spaces 32 of the open mesh 28. In some embodiments, up to 90% of the outer surface 34 is exposed through the open spaces 32 of the open mesh 28. In some embodiments, up to 95% of the outer surface 34 is exposed through the open spaces 32 of the open mesh 28.

The coupling 24 secures the plurality of strands 14 together at the second end 22 of the braided cord 12 to capture the applicator body 20 within the expanded portion 26 of the braided cord 12. The coupling 24 may take the form of fibers from the plurality of strands 14 that are fused together in a melting operation (depicted), a bonding or adhesive that bonds the loose ends of the plurality of strands 14 together, a polymer sleeve or potting that encases the loose ends of the plurality of strands 14, or a metal crimp or staple.

The applicator body 20 may be substantially cylindrical, and may include a fibrous material. Herein, a "fibrous material" is a non-woven material such as a compressed cellulosic material, akin to a tampon or the core of a cigarette filter. In some embodiments, the fibrous material is biodegradable, for example, constructed of cotton fibers, rayon fibers, or a cotton/rayon fiber mix. Other biodegradable fibrous materials include, but are not limited to: wool; hemp; natural burlap; modal; lyocell (TENCEL®); soy cashmere; abaca fibers; bamboo fiber; flax fiber; leaf fibers; sisal fibers; banana stem fiber; coconut husks; natural sea sponge. In addition, the fibrous material may be held together with a biodegradable binder, including but not limited to: natural starch-based binders; cationic starch; carboxymethyl cellulose binder; natural latex; vegetable gums. In some embodiments, the fibrous material is hydroentangled for a main body that is free of binders. A discussion of fibrous materials and associated binders is found at U.S. Patent Application Publication No. 2017/0258128 to Lisauskas entitled "Biodegradable Cigarette Filter Tow and Method of Manufacture," the disclosure of which is hereby incorporated by reference herein, except for patent claims and express definitions contained therein.

The applicator body 20 defines an outer diameter that may be sized approximately the same as the bore diameter of the gun barrel or to provide an interference fit with a bore of a gun barrel. In some embodiments, the expanded portion 26 of the braided cord 12 provides an oversized dimension so that, for rifled barrels, the plurality of strands 14 reaches beyond the bore diameter and into the rifling grooves. Accordingly, the combination of the applicator body 12 and the expanded portion 16 of the braided cord 12 may be configured to contact a diameter of a rifling defined within the gun barrel. The braided cord 12 may be fabricated from a nylon or a rayon material. In some embodiments, the braided cord 12 is fabricated from biodegradable materials, such as those listed above. In some embodiments, the guide weight 16 is fabricated from a polymer, for example by injection molding. The polymer may be a biodegradable polymer, such as polysaccharides, polyglycolide (PGA), polylactide (PLA), poly(lactide-co-glycolide) (PLGA), polycaprolactone (PCL), poly(butylene succinate) (PBS) and its copolymers, poly(p-dioxanone) (PPDO), poly(β-hydroxyalcanoate)s, poly(hydroxybutyrate), poly(hydroxybutyrate-co-hydroxyvalerate), polyanhydrides, polyvinyl alcohol, and biodegradable blends such as starch-poly(ethylene-co-vinyl alcohol) and starch-PLA. Biopolymers are discussed by Vroman, et al., "Biodegradable Polymers", Materials 2009, 2, 307-344, available at www.mdpi.com/1996-1944/2/2/307/pdf, last visited Apr. 4, 2018, the disclosure of which is hereby incorporated by reference in its entirety except for express definitions included therein. In other embodiments, the guide weight 16 is fabricated from a metal, and may be joined to the braided cord 12 by gluing, casting, or crimping at the first end 18.

In manufacturing and assembly, the plurality of strands 14 are interwoven to form the braided cord 12 proximate the first end 18 of the pull-through applicator assembly 10. The plurality of strands 14 are also interwoven about the applicator body 20 proximate the second 22 end of the pull-through applicator assembly 10 to form the open mesh 28 about the applicator body 20. The guide weight 16 is affixed to the first end 18 of the pull-through applicator assembly 10. The plurality of strands 14 are secured to each other at the distal end of pull-through applicator assembly to capture the applicator body 20 within the open mesh 28. Securing the plurality of strands 14 together may include bonding the loose ends of the plurality of strands 14 together in a fusion process, joining with a bonding or adhesive, encasing the loose ends of the plurality of strands 14 in an encasement, or crimping the loose ends of the plurality of strands 14 together. Affixing the guide weight 16 to the first end 18 of the pull-through applicator assembly may include gluing the guide weight 16 to the first end 18 of the pull-through applicator assembly 10, or casting the guide weight 36 about the first end 18.

Figure 3:
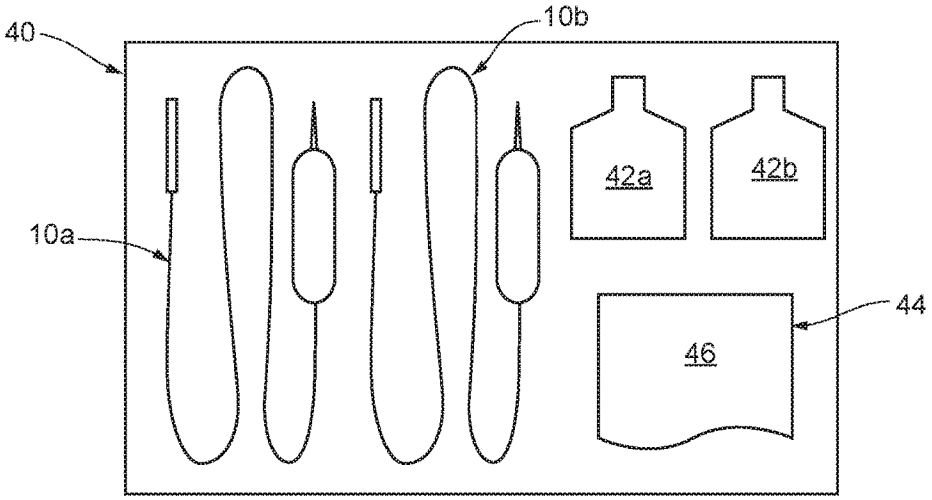
FIG. 3 is a schematic of a kit for maintenance of a gun barrel according to an embodiment of the disclosure.

Referring to FIG. 3, a kit 40 for maintenance of a barrel of a firearm is depicted according to an embodiment of the disclosure. The kit 40 includes a pull-through applicator assembly 10*a*, a packet 42*a* containing a liquid such as a cleaning solvent or rust inhibitor, and instructions 44 on a non-transitory, tangible medium 46. Examples of a non-transitory, tangible medium includes, but is not limited to, a printed document, compact disk, flash drives, or computer hard drives accessed on a personal computer or over the internet. The instructions 44 include passing the guide weight 16 through a barrel of a firearm to exit a muzzle end of the barrel, coating at least a portion of the applicator body 20 of the pull-through applicator assembly 10*a* with the chemical or oil from the packet 42*a*, and pulling the applicator body 20 of the pull-through applicator assembly 10*a* through the barrel of the firearm to exit the muzzle end of the barrel. The instructions 44 may also include discarding the pull-through applicator assembly 10*a* after use.

In some embodiments, the kit 40 may include a plurality of pull-through applicator assemblies 10*a* and 10*b* and a matching plurality of packets 42*a* and 42*b*, for execution of multiple maintenance steps. For example, the kit 40 may include a first packet 42*a* containing a cleaning solvent and a second packet 42*b* containing an oil or other rust inhibitor. The instructions 44 may instruct application of the cleaning solvent of the first packet 42*a* to the first pull-through applicator assembly 10*a* for cleaning the gun barrel, and application of the rust inhibitor of the second packet 42*b* to the second pull-through applicator assembly 10*b* for protection of the internal surfaces of the gun barrel. In some embodiments, a third applicator assembly 10 (not depicted for the kit 40) may be included to wipe the gun barrel of excess solvent before application of the rust inhibitor.

Figure 4:
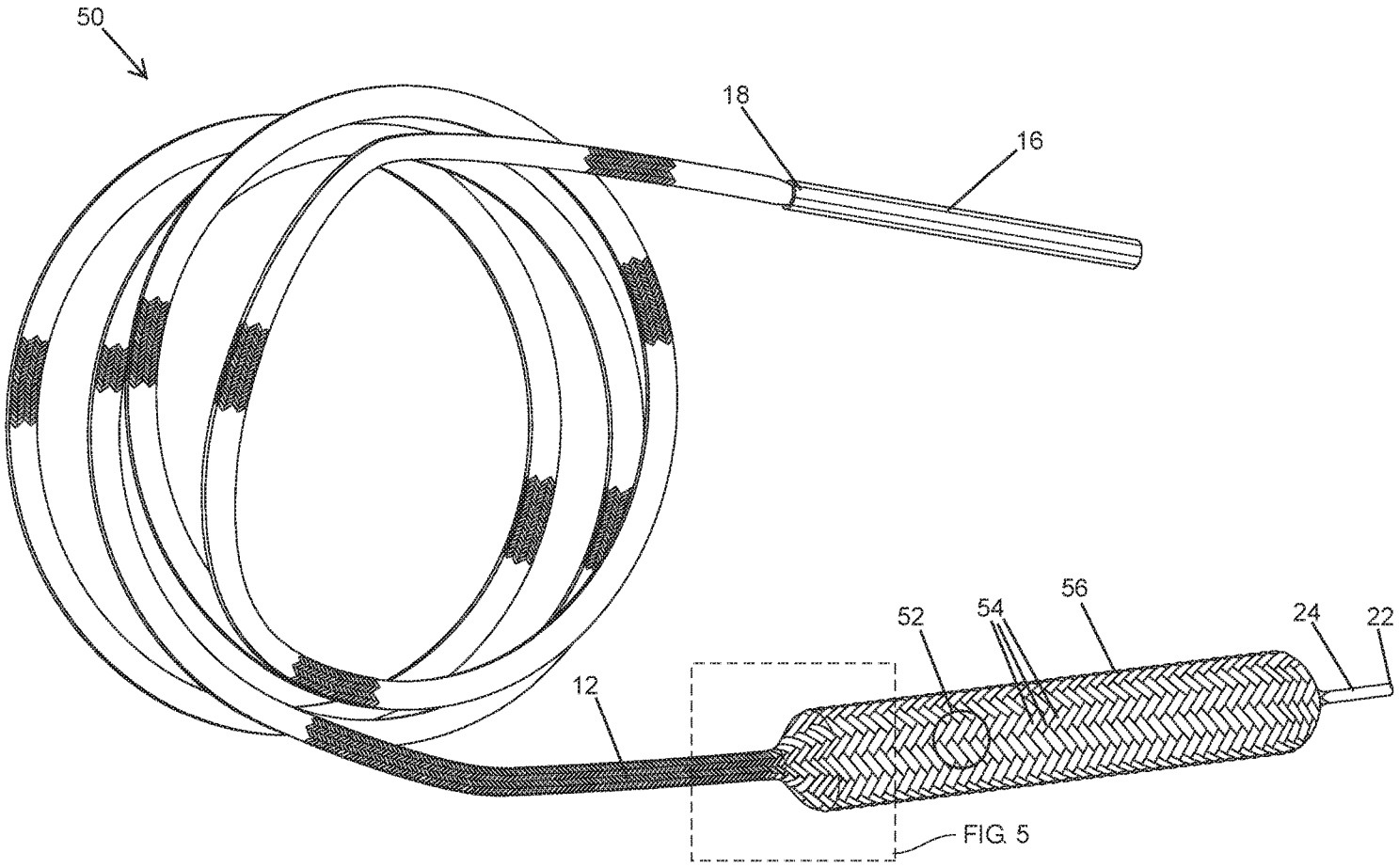
FIG. 4 is a plan view of a pull-through applicator assembly having a thin textile mesh surrounding an applicator body according to an embodiment of the disclosure.
Figure 5:
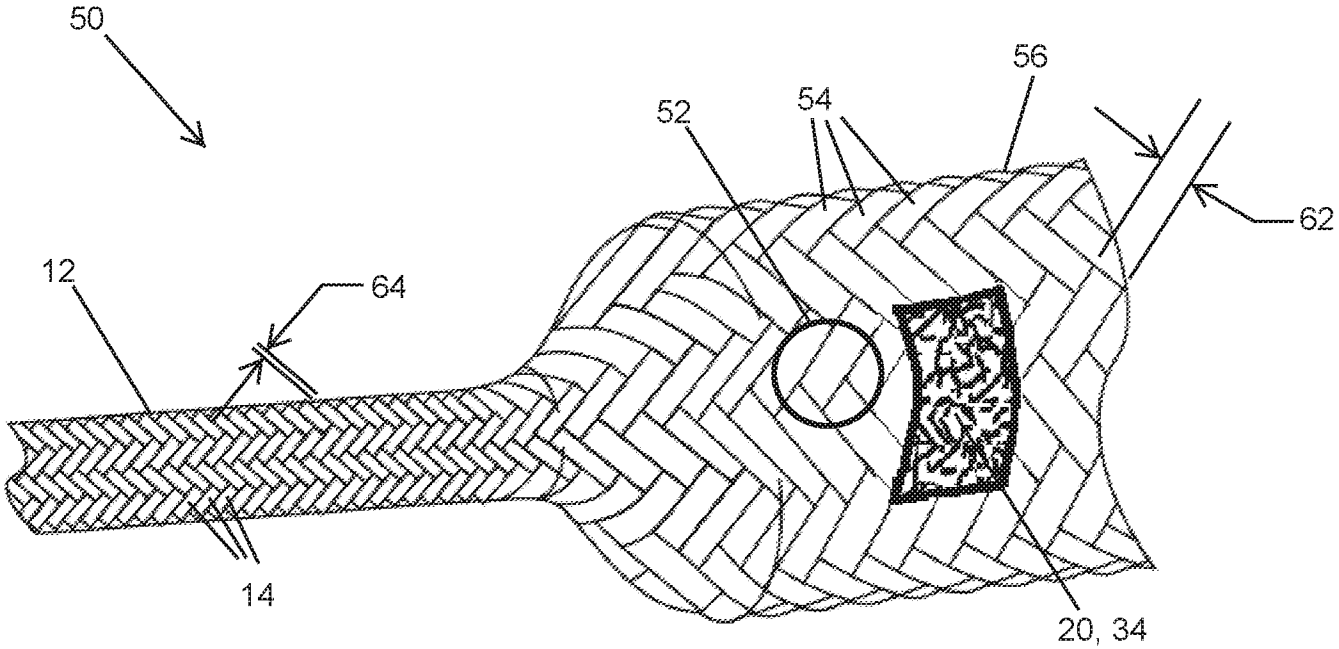
FIG. 5 is an enlarged, partial cutaway view of the pull-through applicator assembly of FIG. 4 according to an embodiment of the disclosure.

Referring to FIGS. 4 and 5, a pull-through applicator assembly 50 for maintenance of a gun barrel is depicted according to an embodiment of the disclosure. The pull-through applicator assembly 50 includes many of the same components and attributes as the pull-through applicator 10, which are indicated by same-numbered reference characters. Instead of an open mesh, a woven mesh 52 of the pull-through applicator assembly 50 surrounds the applicator body 20, the woven mesh 52 covering a majority of the applicator body 20. In some embodiments, the woven mesh 52 covers all of the applicator body 20. Each of the plurality of strands 14, which may have essentially a circular cross-section within the braided cord 12 proximal to the applicator body 20, is spread and flattened as it passes over the applicator body 20, so that the strands 14 effectively form ribbons 54 that surround and capture the applicator body 20. In some embodiments, the applicator body 20 is entirely covered by the ribbons 54 and the strands 14 of the braided cord 12 that expands and passes over the applicator body 20.

In some embodiments, a ratio of a width 62 of the ribbon 54 to a diameter 64 of the circular cross-section of the strand 14 within the braided cord 12 is in a range of 5 to 20 inclusive. Herein, a range that is said to be inclusive includes the end point values of the range as well as all intermediate values within the range. In some embodiments, the woven mesh 52 covers at least 90% of the outer surface 34 of the applicator body 20. In some embodiments, the woven mesh 52 covers at least 80% of the outer surface 34 of the applicator body 20. In some embodiments, the woven mesh 52 covers at least 70% of the outer surface 34 of the applicator body 20.

Functionally, the flattening of the strands 14 into the form of ribbons 54 creates a woven sleeve 56 that is thinner than the thick strands of conventional pull-through applicators. The thinner woven sleeve 56 is more compliant and conforms more readily to the features of the gun barrel relative to the thick strands of conventional pull-through applicators. Accordingly, the thinner woven sleeve 56 more can more effectively clean and maintain such features (e.g., rifling grooves of a rifle barrel).

The pull-through applicator assembly 50 may be fabricated from the same materials as the pull-through applicator assembly 10, including the biodegradable materials discussed above. Also, it is contemplated that the pull-through applicator assembly 50 may be supplied with the kit 40 instead of or in addition to the pull-through applicator assemblies 10*a* and 10*b*.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A pull-through applicator for maintenance of a gun barrel, comprising:

a braided cord including strands that are interwoven, and having first and second ends, said braided cord including a first portion and an expanded portion extending from said first portion proximal to said second end, said expanded portion having a diameter larger than a diameter of said first portion and forming a mesh having openings; and a fibrous applicator body disposed in said expanded portion and surrounded by said mesh, wherein a portion of an outer surface of said fibrous applicator body is exposed through said openings in said mesh.

2. The pull-through applicator of claim 1, further comprising a guide weight coupled to said first end.

3. The pull-through applicator of claim 1, wherein said fibrous applicator body is substantially cylindrical.

4. The pull-through applicator of claim 1, wherein said braided cord, and said fibrous applicator body are biodegradable.

5. The pull-through applicator of claim 1, wherein said openings of said mesh allow about 70% to about 95% of said outer surface to be exposed.

6. The pull-through applicator of claim 1, wherein said fibrous applicator body has an outer diameter substantially the same size as a bore of said gun barrel.

7. The pull-through applicator of claim 6, wherein said fibrous applicator body is configured to contact a rifling defined within said gun barrel.

8. The pull-through applicator of claim 1, further comprising a coupling coupled to said second end, wherein said coupling is a fused region of said strands.

9. The pull-through applicator of claim 1, wherein said braided cord includes at least one of nylon and rayon.

10. A kit for maintaining a barrel of a firearm, comprising:

a pull-through applicator including:

a braided cord including strands that are interwoven, and having first and second ends, said braided cord including a first portion and an expanded portion extending from said first portion proximal to said second end, said expanded portion having a diameter larger than a diameter of said first portion and forming a mesh having openings; and a fibrous applicator body disposed in said expanded portion and surrounded by said mesh, wherein a portion of an outer surface of said fibrous applicator body is exposed through said openings in said mesh;

a packet containing a liquid to be applied to the barrel of the firearm; and instructions including the steps of:

coating at least a portion of said fibrous applicator body with said liquid from said packet; and pulling said fibrous applicator body through said barrel.

11. The kit of claim 10, wherein said liquid is one of a cleaning solvent and a rust inhibitor.

12. A method of manufacturing a pull-through applicator for maintenance of a gun barrel, comprising:

interweaving strands to form a braided cord having first and second ends, and a first portion proximal to said first end; and interweaving said strands around a fibrous applicator body to form an expanded portion of said braided cord proximal to said second end, said expanded portion having a diameter larger than a diameter of said first portion and forming a mesh having openings, wherein a portion of an outer surface of said fibrous applicator body is exposed through said openings.

13. The method of claim 12, further comprising, bonding ends of said strands together at said second end.

14. The method of claim 13, wherein said bonding includes fusing said strands together using a melting process.

15. The method of claim 12, further comprising coupling a polymer guide weight to said first end.

16. The method of claim 15, further comprising forming said guide weight from a biodegradable polymer.

17. The method of claim 12, further comprising fabricating said braided cord and said fibrous applicator body from biodegradable fibers.

18. The method of claim 17, wherein fabricating said fibrous applicator body further includes fabricating said fibrous applicator body using a biodegradable binder.

19. A pull-through applicator for maintenance of a gun barrel, comprising:

a braided cord including strands that are interwoven, and having first and second ends, said braided cord including a first portion and an expanded portion extending from said first portion proximal to said second end, said expanded portion having a diameter larger than a diameter of said first portion and forming a mesh having openings;

a guide weight coupled to said first end; and a fibrous applicator body disposed in said expanded portion and surrounded by said mesh, wherein a portion of an outer surface of said fibrous applicator body is exposed through said openings in said mesh; and a coupling disposed at said second end of said braided cord, wherein:

each of said strands of said braided cord are of a substantially circular cross-section proximal to said fibrous applicator body;

said mesh allows a majority of said outer surface of said fibrous applicator body to be exposed;

said guide weight encases said strands proximate said first end of said braided cord; and said coupling securing said strands together at said second end of said braided cord to capture said fibrous applicator body within said open mesh.

20. The pull-through applicator of claim 19, wherein said braided cord and said fibrous applicator body are biodegradable.

21. The pull-though applicator of claim 19, wherein said openings of said mesh allow at least 70% of said outer surface of said fibrous applicator body to be exposed.

22. The pull-through applicator of claim 19, wherein said strands are flattened into ribbon form to form said mesh.

* * * * *